US012385172B2

(12) United States Patent
Frain et al.

(10) Patent No.: US 12,385,172 B2
(45) Date of Patent: Aug. 12, 2025

(54) PILE FABRIC MADE WITH DIFFERENT FIBER STRANDS

(71) Applicant: DECKERS OUTDOOR CORPORATION, Goleta, CA (US)

(72) Inventors: Helene Frain, Santa Barbara, CA (US); Joao E. Graebin, Ventura, CA (US)

(73) Assignee: DECKERS OUTDOOR CORPORATION, Goleta, CA (US)

( * ) Notice: Subject to any disclaimer, the term of this patent is extended or adjusted under 35 U.S.C. 154(b) by 82 days.

(21) Appl. No.: 18/495,092

(22) Filed: Oct. 26, 2023

(65) Prior Publication Data

US 2024/0141563 A1 May 2, 2024

Related U.S. Application Data

(60) Provisional application No. 63/381,229, filed on Oct. 27, 2022.

(51) Int. Cl.
*D04B 1/02* (2006.01)
*D04B 1/04* (2006.01)

(52) U.S. Cl.
CPC ..... *D04B 1/025* (2013.01); *D04B 1/04* (2013.01); *D10B 2403/0111* (2013.01)

(58) Field of Classification Search
CPC . D04B 1/02; D04B 1/025; D04B 1/04; D04B 7/12; D04B 9/12; D04B 9/14; D04B 11/08; D04B 23/08
See application file for complete search history.

(56) References Cited

U.S. PATENT DOCUMENTS 2,737,702 A * 3/1956 Schmidt ..... D04B 1/025 28/162
2,934,924 A * 5/1960 Herrnstadt ..... D04B 21/02 66/193
3,011,243 A * 12/1961 Herrnstadt ..... D04B 21/04 57/236
3,226,952 A * 1/1966 Cassady ..... D04B 9/14 66/9 B
3,894,407 A * 7/1975 Clingan ..... D04B 9/14 66/9 B
4,244,198 A * 1/1981 Schaab ..... D04B 9/16 66/194
4,340,631 A * 7/1982 Endo ..... D01D 5/20 428/92
4,554,801 A * 11/1985 Thore ..... D04B 9/14 66/42 R
11,713,524 B2 * 8/2023 Hup Yap ..... D04B 35/34 28/162
2006/0228967 A1 * 10/2006 Gladfelter ..... D04B 1/025 442/232

(Continued)

*Primary Examiner* — Danny Worrell
(74) *Attorney, Agent, or Firm* — Greer, Burns & Crain, Ltd

(57) ABSTRACT

A method of making a deep pile fabric that closely resembles natural sheepskin fleece, that includes forming a plurality of straight fiber strands and a plurality of looped fiber strands and simultaneously knitting the straight fiber strands and the looped fiber strands and the scrim together, wherein the straight fiber strands and the looped fiber strands are knit on the scrim in rows, wherein each row includes alternatingly knitting one of the straight fiber strands and one of the looped fiber strands to the scrim.

14 Claims, 5 Drawing Sheets

(56) References Cited

U.S. PATENT DOCUMENTS

| | | | | |
|---|---|---|---|---|
| 2006/0272357 | A1* | 12/2006 | Koenig | D04B 1/14 66/9 B |
| 2008/0209638 | A1* | 9/2008 | Unger | D04B 1/02 5/636 |
| 2009/0064720 | A1* | 3/2009 | Pai | D04B 1/02 66/192 |
| 2009/0170677 | A1* | 7/2009 | Knight, Sr. | D04B 1/025 492/29 |
| 2018/0223459 | A1* | 8/2018 | Sinykin | D04B 1/025 |
| 2021/0025088 | A1* | 1/2021 | Hup Yap | D04B 35/34 |
| 2024/0141563 | A1* | 5/2024 | Frain | D04B 9/14 |

* cited by examiner

PILE FABRIC MADE WITH DIFFERENT FIBER STRANDS

CROSS-REFERENCE TO RELATED APPLICATIONS

This application is a non-provisional application of and claims priority to U.S. Provisional Patent Application No. 63/381,229 filed on Oct. 27, 2022, the entire contents of which is incorporated herein by reference.

BACKGROUND

Sheepskin is a by-product of the meat (lamb) industry. After slaughter, sheepskin is processed including tanning, cleaning, dying and conditioning. Sheepskin can be processed for use as leather only, or can be processed with the wool attached. The term "shearling" as used herein refers to sheepskin with the wool still on, which has been treated on both the skin or leather side and the wool or fleece side. Higher grades of shearling having acceptable quality on both the wool side and the skin side are called "twin-face" sheepskin. Shearling that has an acceptable wool side but an imperfect skin side is referred to as "table grade" sheepskin. The terms "natural fleece" and "fleece" as used herein refers to the natural wool of a sheep, either sheared from the sheep or the wool side of shearling, as distinguished from "polar fleece," which is a soft napped synthetic fabric.

Shearling is used in a variety of products including footwear, outwear, e.g., coats, gloves and hats, rugs, throws, pillows and car seat covers. It is an excellent insulator and yet breathes naturally. Natural wool fleece is soft, wicks moisture and provides for air circulation.

The cost associated with natural sheepskin products depends on the quality and the availability of sheepskin. Sheepskin quality varies considerably depending on many factors, including environmental factors. Accordingly, sheepskin is graded based on whether the sheepskin is a higher quality, i.e., little to no imperfections in the leather, or a lower quality, i.e., having many imperfections. Shearling quality and price is also impacted by the types of sheep that the shearling comes from. Certain types of sheep are more desirable because they produce better quality skins and/or softer fleece. Also, the number of the quality sheepskins available to manufacture the above products is limited by the number of sheep that are available. As demand for shearling and natural fleece products grows, the cost associated therewith also grows.

Accordingly, there is a need for an alternative to shearling that replicates the desirable qualities of sheepskin, increases supply, and reduces the associated costs.

SUMMARY

The present disclosure is directed to a deep pile fabric that closely resembles and can be used in lieu of shearling to make a variety of products including but not limited to footwear, apparel products ad home goods. In very general terms, the present method involves forming a deep pile fabric, and then finishing the fabric as if the fabric was natural sheepskin. Wool pile fabrics are known, but are generally unsuitable for use in clothing and footwear because the wool pile is coarse, bristly, abrasive and does not breathe well, i.e., allow air to circulate. The present disclosure is directed to processing method that achieves a deep pile fabric that very closely approximates natural wool fleece and shearling. The fabric is soft and exhibits the same performance characteristics of natural sheepskin fleece while also allowing air to move through the pile fabric to circulate air for breathability.

In an embodiment, a method of making a deep pile fabric that closely resembles natural sheepskin fleece is provided and includes forming a plurality of straight fiber strands and a plurality of looped fiber strands and simultaneously knitting the straight fiber strands and the looped fiber strands and the scrim together, wherein the straight fiber strands and the looped fiber strands are knit on the scrim in rows, wherein each row includes alternatingly knitting one of the straight fiber strands and one of the looped fiber strands to the scrim.

In another embodiment, a method of making a deep pile fabric that closely resembles natural sheepskin fleece is provided and includes forming a plurality of straight fiber strands and a plurality of looped fiber strands and simultaneously knitting the straight fiber strands and the looped fiber strands and the scrim together, wherein the straight fiber strands and the looped fiber strands are knit on the scrim in rows, wherein each row includes alternatingly knitting rows of only straight fiber strands and rows of only looped fiber strands to the scrim.

In another embodiment, a deep pile fabric is provide on the above method and includes a textile scrim and a plurality of straight fiber strands and a plurality of looped fiber strands attached to the textile scrim, wherein the plurality of straight fiber strands and the plurality of looped fiber strands are attached in rows on the scrim, and wherein each row includes alternatingly attaching a straight fiber strand and a looped fiber strand to the scrim.

DETAILED DESCRIPTION

Figure 1:
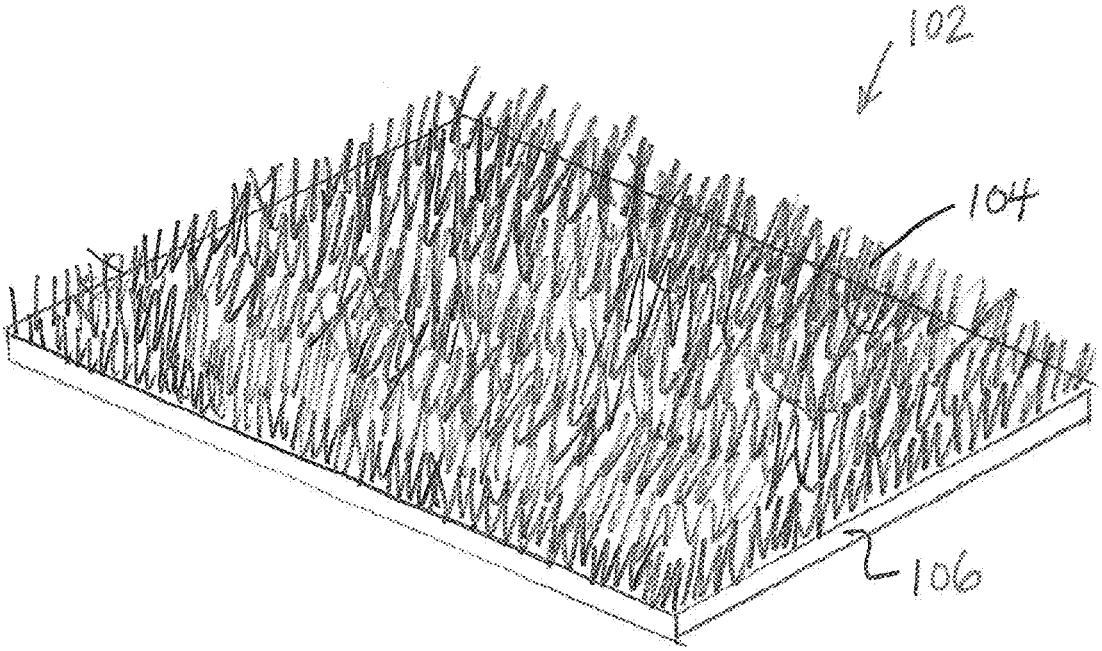
FIG. 1 is a perspective view of an embodiment of the present pile fabric.
Figure 2:
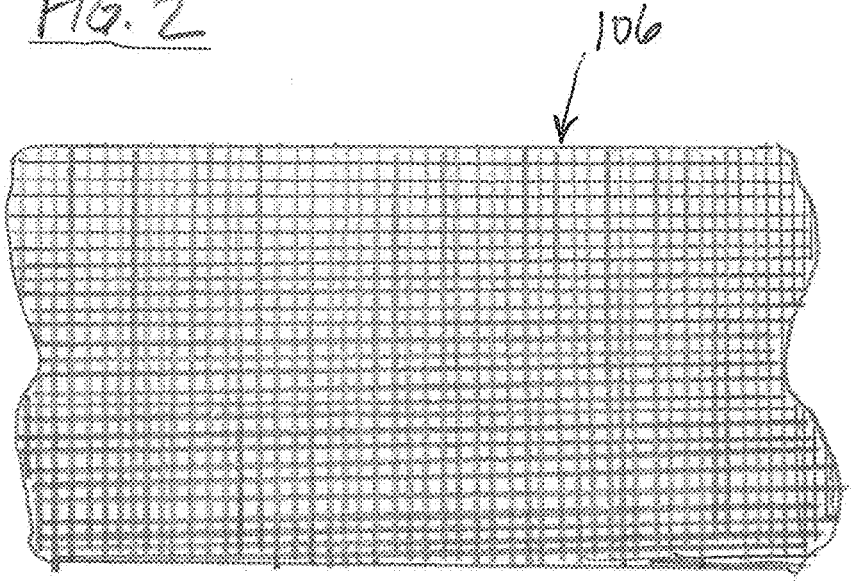
FIG. 2 is a bottom view of the pile fabric of FIG. 1.
Figure 3:
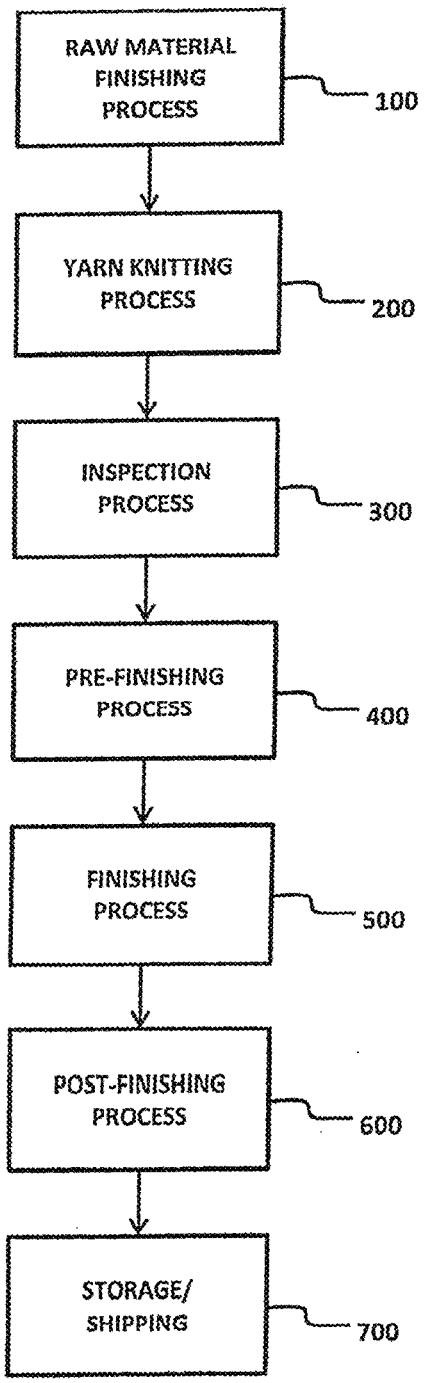
FIG. 3 is a flow diagram illustrating the manufacturing process.

Various embodiments of the invention are described below by way of example only, with reference to the accompanying drawings. The drawings include schematic figures that may not be to scale, which will be fully understood by skilled artisans with reference to the accompanying description. Features may be exaggerated for purposes of illustration. From the preferred embodiments, artisans will recognize additional features and broader aspects of the invention.

The present disclosure is directed to a method of processing fibers such as fiber strands, securing the fiber strands to a textile scrim, and finishing the same to make a deep pile fabric that can be used in lieu of shearling in making footwear, apparel and other products. The pile fabric formed by the process of the present invention closely approximates shearling and can be used in lieu of shearling in many applications. In one application, the pile fabric is used to make artificial shearling for use as a liner for footwear, coats, gloves, home goods and other products in lieu of natural shearling.

Referring to FIGS. 1-7, the present method for making the wool pile fabric includes the following processes: a raw material finishing process 100, a knitting process 200, an inspection process 300, a pre-finishing process 400, a finishing process 500, a post-finishing process 600 and a storage/shipping process 700 for producing the pile fabric 102. Examples of the pile fabric 102 are shown in FIGS. 1, 2, 4 and 5. The present disclosure is directed to the knitting process 200. The raw material finishing process 100, the inspection process 300, the pre-finishing process 400, the finishing process 500, the post-finishing process 600 and the storage/shipping process 700 are described in U.S. Pat. Nos. 9,212,440 and 10,287,720, which are both incorporated herein by reference.

In the knitting process 200, the fiber strands 104 are secured to a base material, such as a textile scrim 106, in a fabric forming process 200, such as knitting. It should be appreciated that the term "scrim" used hereinafter refers to an underlying backing, framework or structure, including but not limited to, textiles. Furthermore, the terms "fabric" and "textile" as used herein refer to any type of cloth produced by knitting, weaving or non-woven textile processes. Although various fabric forming processes can be used consistent with this disclosure, knitting is a preferred process as described below.

In the knitting process 200, the textile scrim 106 is made with a scrim material, such as a polyester yarn, and is simultaneously knitted with the fibers strands 104 generated from fiber slivers to create a durable, single circular knit pile fabric 102. Other types of scrim material may be used, including both natural fiber yarns, e.g., cotton, as well as synthetic yarns, such as polyester, recycled polyester, or plant-based materials or any suitable material or combination of materials.

Figure 4:
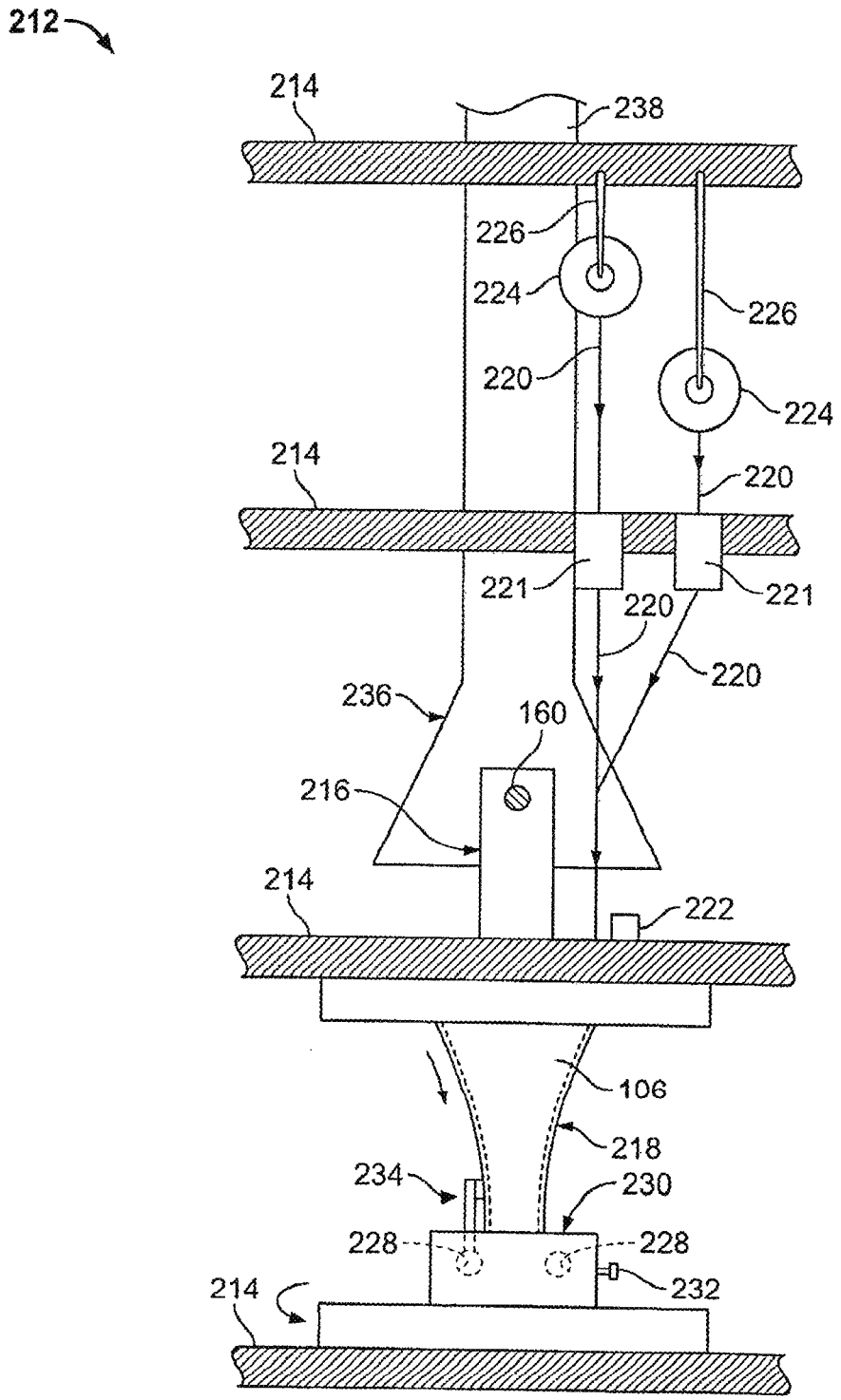
FIG. 4 shows a knitting machine used in the present process.
Figure 5:
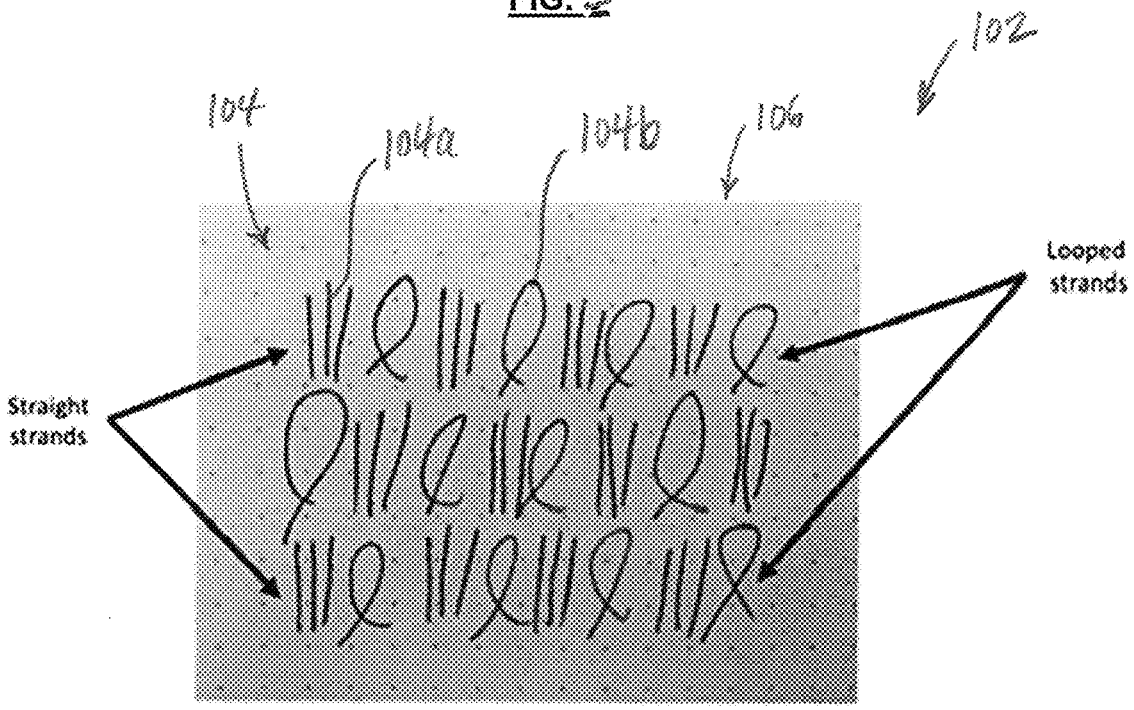
FIG. 5 is a schematic view of a backing material showing an embodiment of the pile fabric of FIG. 1 made with a combination of different fiber strands.

Referring now to FIG. 4, a knitting machine 212 includes a frame 214 and a plurality of knitting heads or knitting feed devices 216 mounted to the frame for knitting fiber strands 104 from wool fiber slivers 160 to form a tubular knit semi-finished fabric 218. Initially, a calibration step 202 is performed where the tension and pattern for the sliver feeds of the knitting feed devices 216 are calibrated to ensure that the knitting machine 212 is within designated parameters and tolerances for knitting a particular fabric product. In an embodiment, the knitting devices 216 are calibrated to knit at a designated speed and a density of 2450 to 2550 g/linear meter. It should be appreciated that the knitting devices 216 of each knitting machine 212 may be calibrated to operate at other suitable speeds and densities.

The present method utilizes a plurality of knitting machines 212 where each of the knitting machines has a plurality knitting feed devices 216. It should be appreciated that the present method may employ one or a plurality of knitting machines 212 each having a suitable number of feed devices 216. Each feed device 216 of the knitting machines 212 is preferably configured to receive one of the fiber slivers 160 and material strands 220 supplied by respective spools 224 loaded on L-shaped support arms 226 connected to and extending from the frame 214 in loading step 204. It should be appreciated that the number of spools 224 loaded on the machine depends on the size of the pile fabric 102. Specifically, the fiber slivers 160 are moved adjacent to and fed into the knitting feed devices 216 on each of the knitting machines 212 in the loading step 206. After both the spool(s) 224 and the fiber sliver(s) 160 are loaded and fed into the knitting devices 216 and are fed into corresponding feeding devices 221, each of the knitting machines 212 is activated, i.e., turned "on," to start the knitting process.

During the knitting process 200, the strands forming the scrim 106 and the wool fibers 104 from the slivers 160 are simultaneously knit together in the knitting step 208 to produce a tubular knit pile fabric 218, hereinafter referred to as a "semi-finished pile fabric." To ensure that the fiber strands 104 are in proper position relative to the strands 220 to be knitted together by each of the knitting feed devices 216, a fiber blower 222 is associated with each of the knitting feed devices 216 and generates a stream of air directed at the fibers strands 104. The air stream from each fiber blower 222 also causes the fiber strands 104 in the semi-finished pile fabric 218 to be angled in a direction away from the blowers, which will be relevant in subsequent processing steps described in more detail below. It should be appreciated that scrim 106 may be made with any suitable material or combination of materials and is typically made with a fabric material. It should also be appreciated that other suitable yarning processes, knitting processes, weaving processes or attachment processes known to a person skilled in the art may be used to attach the fiber strands 104 to the scrim 106 to form the pile fabric.

In the knitting process 200, the semi-finished pile fabric 218 is knitted until it reaches a designated length. At which time the semi-finished pile fabric 218 is inserted between a pair of support bars 228 that are rotatably connected to the frame 214 of the knitting machine 212. Specifically, the support bars 228 are connected at one end to a fixed mount 230 and at an opposing end to a motor (not shown) where the tension of the support bars is adjusted by manually turning a handle 232 connected to the fixed mount. The motor includes at least one drive roller that is rotated by the motor and contacts an inner surface of the knitting machine 212. The drive roller is preferably made of a suitable traction material, such as rubber, for gripping and rolling on the inner surface for rotating the support bars 228. The rotation of the support bars 228 similarly rotates so that the semi-finished pile fabric 218 is knit as a continuous tube.

In the knitting process 200, a plurality of straight fiber strands 104*a* and a plurality of looped fiber strands 104*b* are simultaneously attached to the scrim 106. In an embodiment, the straight fiber strands 104*a* and the looped strands 104*b* are attached to the scrim 106 in rows where the straight fiber strands and the looped fiber strands are alternatingly attached to the scrim. In the illustrated embodiment, each row on the scrim 106 includes three straight fiber strands 104*a* and one looped fiber strand 104*b* alternatingly attached to the scrim 106. It should be appreciated that different configurations and/or patterns of the straight fiber strands 104*a* and the looped fiber strands 104*b* may be attached to the scrim 106. This method of attaching the straight fiber strands 104*a* and the looped fiber strands 104*b* enhances the comfort of the pile fabric 102 while enabling better breathability (air flow) through the pile fabric. The result is that the pile fabric 102 provides enhanced moisture management to help keep a user's feet dry during use while the higher density of the pile fabric provides enhanced comfort.

The hybrid weaving process of alternatingly attaching, by weaving, the straight fiber strands 104*a* and the looped fiber strands 104*b* to the scrim 106 provides a range of effects and different levels of performance and sustainable features to the resulting pile fabric 102. In an embodiment, the rows of fiber strands 104 attached to the scrim 106 alternate where a first row has only straight fiber strands 104*a* and a second row has only looped fiber strands 104*b* and each subsequent row alternates between straight fiber strands and looped fiber strands. It should be appreciated that the number of rows of straight fiber strands 104*a* and looped fiber strands 104*b* may be any suitable number. Also, the straight fiber strands 104*a* and the looped fiber strands 104*b* may be made with a synthetic material, such as polyester, recycled polyester or acrylic, a bio-based material, such as Sorona, a plant-based material such as Tencel, hemp or linen, or animal fibers, such as wool or cashmere. The combination of one or more of these materials in the straight fiber strands and/or the looped fiber strands may provide temperature properties (insulation, thermos-regulation, wicking or similar properties) and also provide anti-bacterial and/or anti-odor properties.

Figure 6:
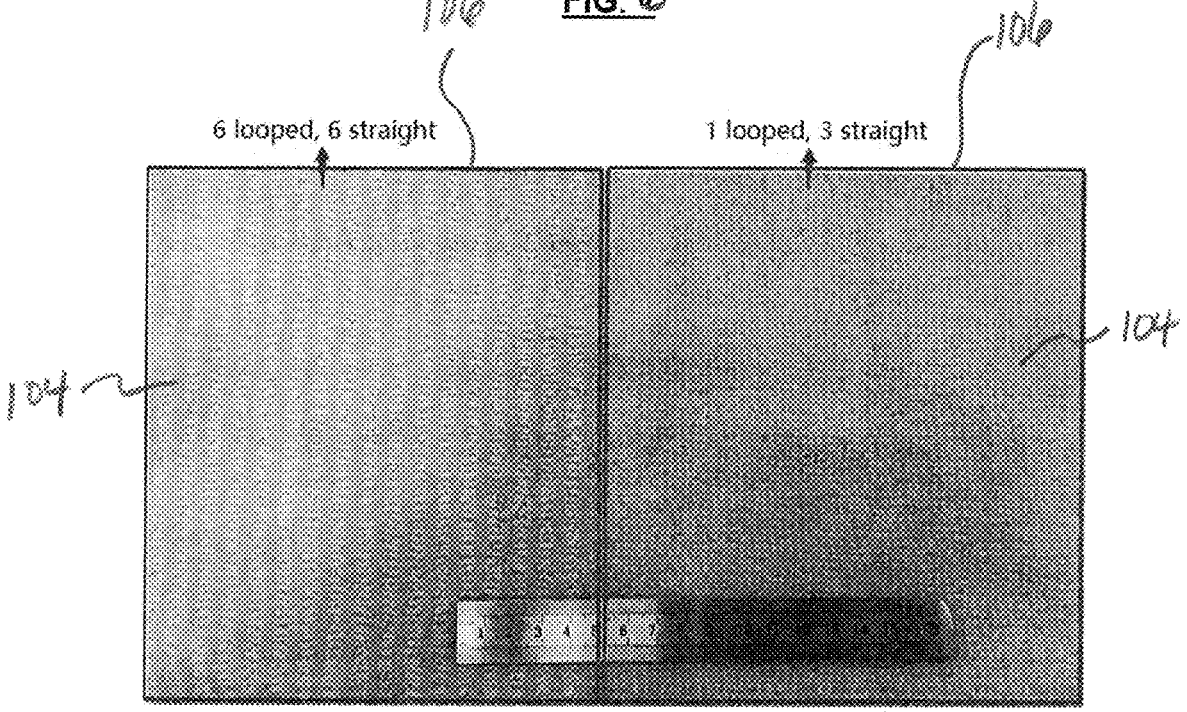
FIG. 6 is a bottom view of another embodiment of the pile fabric made with a different combination of fiber strands.
Figure 7:
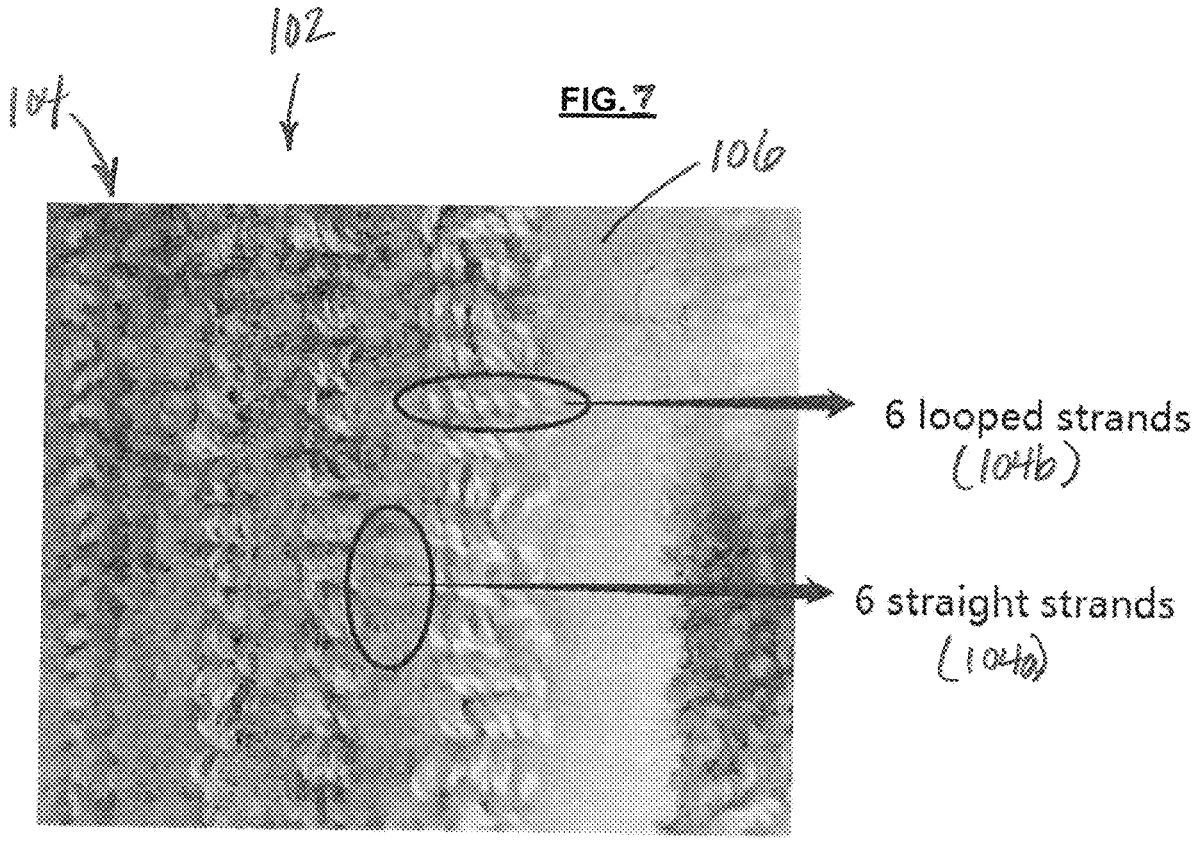
FIG. 7 is a bottom view of a further embodiment of the pile fabric made with a different combination of fiber strands.

Referring to FIGS. 6 and 7, an embodiment of the pile fabric 102 includes weaving rows of fiber strands 104 to the scrim 106 where each row includes alternatingly weaving six straight fiber strands 104*a* and six looped fiber strands 104*b* to the scrim 106. It should be appreciated that each row may include alternatingly weaving one or more straight fiber strands 104*a* and one or more looped fiber strands 104*b* to the scrim 106. In another embodiment shown in FIG. 6, each row on a scrim 106 includes alternatingly weaving one looped fiber strand 104*b* and three straight fiber strands 104*a* to the scrim.

After being shipped, the pile fabric 102 is used to make different end products such as footwear, apparel, i.e., coats, gloves, hats, home goods and other products. In one example, the pile fabric is used as a liner for footwear, apparel and other products in lieu of conventional sheepskin.

While particular embodiments of the present pile fabric and method have been described herein, it will be appreciated by those skilled in the art that changes and modifications may be made thereto without departing from the invention in its broader aspects.

What is claimed is:

1. A method of making a deep pile fabric that closely resembles natural sheepskin fleece, the method comprising:

forming a plurality of straight fiber strands and a plurality of looped fiber strands, said plurality of looped fiber strands each forming a continuous loop and having ends that cross each other; and simultaneously knitting ends of the straight fiber strands and the ends of the looped fiber strands and a scrim together, wherein the straight fiber strands and the looped fiber strands are knit on the scrim in rows to form a pile extending from the scrim, wherein each row includes alternatingly knitting one of the straight fiber strands and one of the looped fiber strands to the scrim.

2. The method of claim 1, wherein each row includes alternatingly knitting three straight fiber strands and one looped fiber strand to the scrim.

3. The method of claim 1, wherein each row includes alternatingly knitting six straight fiber strands and six looped fiber strands to the scrim.

4. The method of claim 1, wherein the knitting step includes alternatingly knitting a row of straight fiber strands and a row of looped fiber strands to the scrim.

5. The method of claim 1, wherein the plurality of straight fiber strands and the plurality of looped fiber strands are made with a synthetic material, a bio-based material, a plant-based material or animal fibers.

6. A method of making a deep pile fabric that closely resembles natural sheepskin fleece, the method comprising:

forming a plurality of straight fiber strands and a plurality of looped fiber strands, said plurality of looped fiber strands each forming a continuous loop and having ends that cross each other; and simultaneously knitting ends of the straight fiber strands and the ends of the looped fiber strands and a scrim together, wherein the straight fiber strands and the looped fiber strands are knit on the scrim in rows to form a pile extending from the scrim, wherein each row includes alternatingly knitting rows of only straight fiber strands and rows of only looped fiber strands to the scrim.

7. The method of claim 6, wherein the knitting step includes alternatingly knitting a plurality of rows including only straight fiber strands and plurality of rows including only looped fiber strands to the scrim.

8. The method of claim 6, wherein the plurality of straight fiber strands and the plurality of looped fiber strands are made with a synthetic material, a bio-based material, a plant-based material or animal fibers.

9. A deep pile fabric comprising:

a textile scrim; and a plurality of straight fiber strands and a plurality of looped fiber strands attached to the textile scrim, said plurality of looped fiber strands each forming a continuous loop and having ends that cross each other, wherein ends of the plurality of straight fiber strands and the ends of the plurality of looped fiber strands are attached in rows on the scrim to form a pile extending from the textile scrim, and wherein each row includes alternatingly attaching a straight fiber strand and a looped fiber strand to the scrim.

10. The pile fabric of claim 9, wherein each row includes alternatingly attaching three straight fiber strands and one looped fiber strand to the scrim.

11. The pile fabric of claim 9, wherein each row includes alternatingly attaching six straight fiber strands and six looped fiber strands to the scrim.

12. The pile fabric of claim 9, wherein the rows include alternatingly attaching a row of only straight fiber strands and a row of only looped fiber strands to the scrim.

13. The pile fabric of claim 9, wherein the rows include alternatingly attaching plurality of rows of straight fiber strands and a plurality of rows of looped fiber strands to the scrim.

14. The pile fabric of claim 9, wherein the straight fiber strands and the looped fiber strands are made with a synthetic material, a bio-based material, a plant-based material or animal fibers.

* * * * *